US006323412B1

(12) United States Patent
Loo

(10) Patent No.: US 6,323,412 B1
(45) Date of Patent: Nov. 27, 2001

(54) METHOD AND APPARATUS FOR REAL TIME TEMPO DETECTION

(75) Inventor: George K. Loo, Santa Clara, CA (US)

(73) Assignee: Mediadome, Inc., Santa Clara, CA (US)

( * ) Notice: Subject to any disclaimer, the term of this patent is extended or adjusted under 35 U.S.C. 154(b) by 0 days.

(21) Appl. No.: 09/632,374

(22) Filed: Aug. 3, 2000

(51) Int. Cl.[7] ..... G10H 1/40
(52) U.S. Cl. ..... 84/636; 84/668; 84/DIG. 12
(58) Field of Search ..... 84/603, 611, 636, 84/652, 661, 668, 714, 675–677, 484, DIG. 11, DIG. 12

(56) References Cited

U.S. PATENT DOCUMENTS 5,911,170 * 6/1999 Ding ..... 84/661

* cited by examiner

*Primary Examiner*—Stanley J. Witkowski
(74) *Attorney, Agent, or Firm*—Blakely, Sokoloff, Taylor & Zafman LLP

(57) ABSTRACT

A method for real time tempo detection is disclosed. The method includes receiving an audio input, downsampling the input, converting the input from time domain data to frequency domain data, dividing the frequency domain data into a plurality of frequency bands. Each frequency band is associated with a resonator bank, which has a plurality of resonators. Each resonator has a center frequency. The method further comprises of filtering out high order noise of the frequency domain data, stimulating the resonator bank with the filtered frequency domain data, summing up the amplitudes of the outputs of the resonators of the same center frequency. Each local maximum corresponds to a tempo contained within the audio input. The method further comprises of sorting the local maxima by the sum of the amplitudes and returning the tempo corresponding to the largest local maxima for determination of tempo of the audio input.

21 Claims, 4 Drawing Sheets

Initial State

| T = Last Iteration | T = 0 | T = 1 | T = 2 | T = 3 |
|---|---|---|---|---|
| 0.3 | 0.5 | 0.4 | 0.3 | 0.2 |

310

Oldest Entry is Shifted Out

| T = Last Iteration | T = 0 | T = 1 | T = 2 | T = 3 |
|---|---|---|---|---|
| 0.5 | 0.4 | 0.3 | 0.2 | 0 |

New Impulse Superposition Starting at Element 2

| T = Last Iteration | T = 0 | T = 1 | T = 2 | T = 3 |
|---|---|---|---|---|
| 0.5 | 0.4 | 0.3 | 0.2 | 0 |

| | | | | |
|---|---|---|---|---|
| | 0.5 | 0.9 | 0.6 | 0.4 |

The Resulting Buffer

| T = Last Iteration | T = 0 | T = 1 | T = 2 | T = 3 |
|---|---|---|---|---|
| 0.5 | 0.9 | 1.2 | 0.8 | 0.4 |

FIG. 3

METHOD AND APPARATUS FOR REAL TIME TEMPO DETECTION

FIELD OF THE INVENTION

The present invention pertains to the field of audio signal processing. More particularly, this invention pertains to the field of real time tempo detection of audio signal.

BACKGROUND OF THE INVENTION

Real time tempo detection in a music-playing computer application allows the application to coordinate its display such that the application can respond to the audio input. For example, in response to a musical input, an application can generate three-dimensional (3D) graphical display of dancers dancing to the rhythm of the music. In addition, the application can arrange pulsation of lights in response to the rhythm of the music.

However, prior personal computer systems do not provide real time tempo detection. The major obstacle faced by developers of real-time tempo detection techniques is inefficiency. Due to the large amount of processing required by prior art methods, a personal computer running a prior art tempo detection method in the background cannot run another application, e.g. 3D graphical display, in the foreground at the same time. The central processing unit (CPU) of the computer is "hogged" by the tempo detection algorithm. Reducing the sampling rate of prior tempo detection methods does not solve the problem because it causes the result to be inaccurate and unreliable. Thus, computer applications cannot incorporate prior tempo detection methods to enhance the audio and visual effects. An efficient method for real time tempo detection, without compromising the accuracy, is highly desirable.

SUMMARY OF THE INVENTION

A method and apparatus for real time tempo detection is disclosed. A computer-implemented method for determining tempo in real time, comprising receiving an audio input, dividing the audio input into a plurality of blocks of data, converting each of the plurality of blocks of data from time domain data to frequency domain data, the frequency-domain data comprising amplitude and phase data and stimulating a plurality of resonator banks with the frequency domain data, to cause the resonator banks to generate outputs with various amplitudes. Other features and advantages of the present invention will be apparent from the accompanying drawings and from the detailed description that follows below.

BRIEF DESCRIPTION OF THE DRAWINGS

The invention is illustrated by way of example and not limitation in the figures of the accompanying drawings, in which like references indicate similar elements, and in which:

FIG. 3 is shows one embodiment of an envelope buffer.

DETAILED DESCRIPTION

Figure 1:
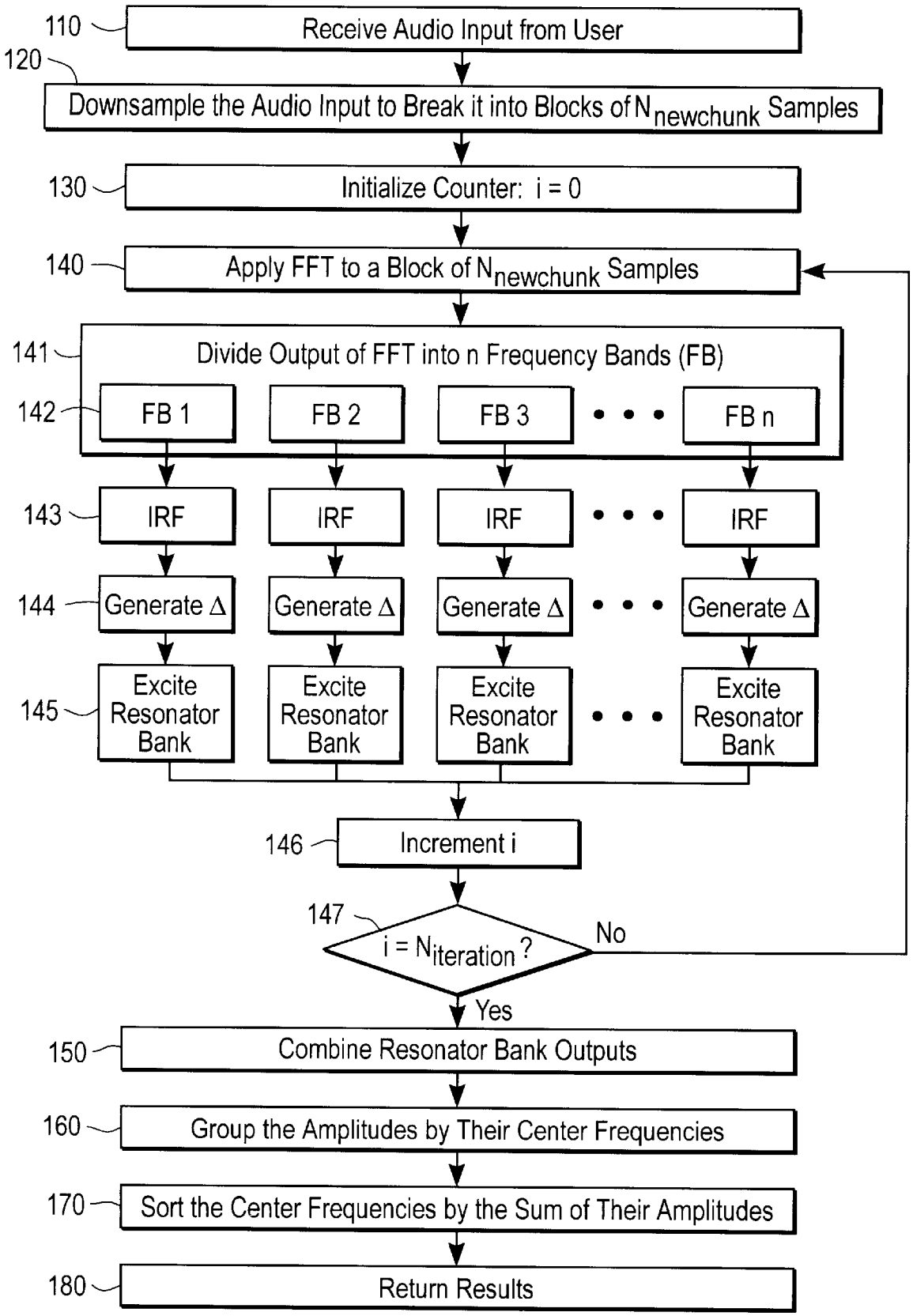
FIG. 1 shows a flow diagram of one embodiment of the process for performing real time tempo detection.

One embodiment of a method for real time tempo detection is disclosed. One embodiment of the real time tempo detection methodology comprises receiving an audio input from a user or a calling application, downsampling the input, converting the audio input from time-domain data to frequency domain data, and dividing the frequency domain data into multiple frequency bands. Each frequency band is associated with a resonator bank having multiple resonators, where each resonator has a center frequency. The data associated with each frequency band is passed through an Impulse Response Function (IRF) to filter out high order noise, stimulating the resonator bank with the filtered frequency domain data, such that the resonators within the resonator bank generate amplitudes of various sizes. The amplitudes of the outputs of the resonators are summed, with each local maximum corresponding to a tempo contained within the audio input. The local maxima are sorted and the tempos corresponding to the largest local maxima are returned to the user or the calling function as an indication of the tempo of the audio input.

In the following description, numerous details are set forth, such as types of audio data formats, range of frequencies, etc. It will be apparent, however, to one skilled in the art, that the present invention may be practiced without these specific details. In other instances, well-known structures and routines are shown in block diagram form, rather than in detail, in order to avoid obscuring the present invention.

Some portions of the detailed descriptions which follow are presented in terms of algorithms and symbolic representations of operations on data bits within a computer memory. These algorithmic descriptions and representations are the means used by those killed in the data processing arts to most effectively convey the substance of their work to others skilled in the art. An algorithm is here, and generally, conceived to be a selfconsistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g. a computer). For example, a machine-readable medium includes read only memory ("ROM"); random access memory ("RAM"); magnetic disk storage media; optical storage media; flash memory devices; electrical optical, acoustical or other form of propagated signals (e.g., carrier waves, infrared signals, digital signals, etc.); etc.

FIG. 1 is a flow diagram of one embodiment of a process for real time tempo detection. The process is performed by processing logic that may comprise hardware (e.g., dedicated logic), software (e.g., such as runs on a personal computer or a dedicated machine), or a combination of both.

The process begins by processing logic receiving an audio input (processing block 110). In one embodiment, a user or a calling computer application supplies blocks of audio data input to the processing logic (e.g., a computer system). The audio input may come in various formats, e.g. 44 kHz/16 bit/stereo, 11 kHz/8 bit/mono, etc.

Next, processing logic divides the audio data into blocks (processing block 120). In one embodiment, processing logic downsamples the audio input into blocks of $N_{newchunk}$ samples. Downsampling enables the technique described herein to handle input data of various formats. Furthermore, downsampling the audio data also reduces the complexity of the tempo detection technique because the method can be optimized to handle audio data blocks of a fixed format. In one embodiment, the processing handles the data internally in the format of 11 kHz mono 32 bit floating point. Higher sampling rates or bit depths may be used, but are unnecessary. Much lower quality sampling rates (~5 kHz) may be used with marginal impact on the functioning of the algorithm. A simple averaging technique may be used to reduce sample rate down to a monaural 11 kHz. At the same time, the sample depth is converted to a normalized (−1.0 to 1.0) floating point representation.

Each of the blocks of samples is processed by iterations of processing blocks 140–147 in FIG. 1. For example, if $N_{sample}$ is the number of audio data samples within a block of audio input, $N_{newchunk}$ is the number of samples within a smaller block, which is processed by an iteration, and $N_{oversample}$ is the number of iterations required to process the entire input block of data, then $$N_{sample}=N_{oversample}*N_{newchunk}$$

Prior to iterating, processing logic initializes a counter variable to zero (processing block 130). Thereafter, processing logic converts the samples of audio input from the time domain to the frequency domain (processing block 140).

An input buffer may be used to store multiple blocks of data. During each iteration, the newest block of $N_{newchunk}$ data is placed at the end of the input buffer, while the oldest block of $N_{newchunk}$ data is discarded from the buffer. The input buffer can hold at least $N_{sample}$ samples of data. In one embodiment, processing logic uses a floating point Fast Fourier Transform (FFT) routine optimized for 256 points to convert the input data. However, other well-known routines may be used to accomplish the transformation. In general, one should choose a routine that performs the transformation quickly to enhance the performance of the tempo detection.

In one embodiment, the processing logic removes the phase data of the FFT outputs, retaining only the amplitudes of the FFT outputs. Processing logic divides the output of the transformation (e.g., the FFT) into multiple frequency bands (processing block 141). FB1 (142) represents the first frequency band, while $FB_N$ represents the last. In one embodiment, due to the non-linear characteristics of human ear, the frequency bands are arranged in a logarithmic distribution. Since different musical instruments have different frequency ranges, they can be tracked in separate groups using the frequency bands. For example, drums and bass instruments are in the lower frequency bands, while violins and flutes are in the higher frequency bands. In one embodiment, the amplitudes are divided into 8 frequency bands because using more than 8 bands does not significantly improve performance, and using 4 bands or fewer yields poorer results.

Figure 2:
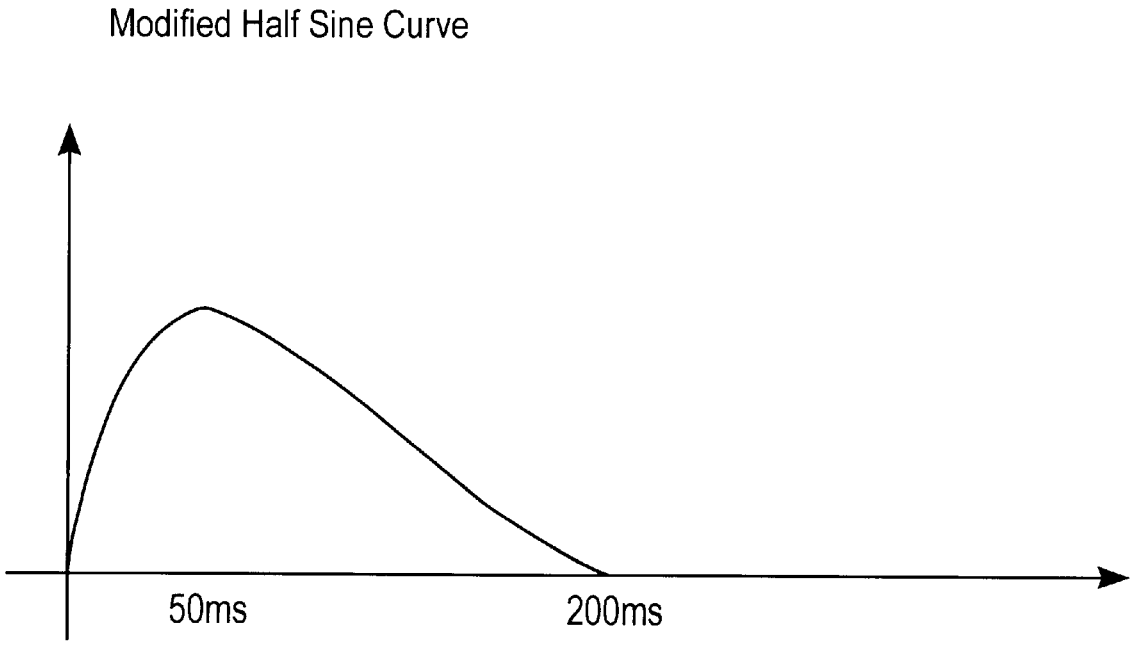
FIG. 2 is an example of a modified half sine curve used by an IRF.

After dividing the output of the transformation with frequency bands, a series of operations are performed on each frequency band. First, processing logic passes the amplitudes in each frequency band through an Impulse Response Function (IRF) to filter out high order noise (processing block 143). In one embodiment, the IRF is based upon a modified half sine curve. The exact shape of the curve is not critical but a curve with a sharper onset and slow decay seems to work best. In one embodiment, the area under the curve should add up to 1.0, and the curve should rise sharply within the first 10–50 ms and taper off to zero over the next 150–250 ms. FIG. 2 shows an example of such a curve. It rises sharply between 0–50 ms, then tapers off to zero during 50–200 ms. However, it would be apparent to one of ordinary skill in the art that other noise filtering techniques may be used to remove the high order noise.

After the amplitudes have passed through the IRF, processing logic generates the difference (Δ) between the last IRF output and the current IRF output of each frequency band (processing block 144). In one embodiment, this is accomplished by first storing the outputs of the IRF in an envelope buffer. The envelope buffer is a one-dimensional array containing the super-positioned outputs of the IRF. FIG. 3 shows an example of an envelope buffer. Referring to FIG. 3, at each iteration, processing logic shifts the buffer 310 by one position to remove the oldest value, "T=last iteration/0.3". A zero is then appended to the end of the buffer. The processing logic superpositions the IRF output over the existing data starting at the second oldest element (i.e., under "T=0"), which represents the current value. For example, under "T=1," "0.9" is added to "0.3" to yield "1.2". Then processing logic subtracts the value of the last iteration from the current iteration to produce a difference value (Δ). In the example, the value of the current iteration is 0.9 and the value of the last iteration is 0.5. Thus, Δ is (0.9–0.5)=0.4. If Δ is negative, processing logic uses a zero in its place instead. The delta Δ indicates the change in the amplitude of the incoming data. If there is no change, Δ is 0. The IRF shapes the input data so that the onset is steep and it decays slowly. Therefore, Δ reflects it as relatively large and narrow peaks, indicating the leading edge of a note or sound.

Once the Δ values have been generated, processing logic uses the Δ generated from the outputs of the IRF to stimulate the resonator bank (processing block 145). Each frequency band is associated with a resonator bank. The resonator bank comprises resonators to synchronize with the beat information generated by the tempo detection techniques. In one embodiment, each resonator has an adjustable center frequency and a Q value. The Q value is adjusted such that the resonance is dampened after several seconds. In one embodiment, the resonators are damped to 0.5 their original values after about 1.5–2.5 seconds. The resonators allow the amplitude and the phase of the signal be analyzed without altering the values. The resonators may be implemented by software, hardware, or a combination of both.

In one embodiment, the resonators are arranged into large arrays with their center frequencies distributed between 1 Hz and 3 Hz. The distribution can be linear, logarithmic or exponential across the entire range of 1 to 3 Hz. With a large number of resonators, all three types of distributions yield similar results. However, when using a small number of resonators, the logarithmic distribution is preferred. The exact number of resonators can be adjusted depending on requirements of the computer and the accuracy desired. In one embodiment, a hundred resonators are provided in each bank.

If the period and phase of stimulation coincides with a particular resonator, oscillation of the resonator will be reinforced. In other words, the amplitude generated by the resonator is larger than the amplitudes generated by resonators which do not coincide with the stimulation. If the stimulation is out of phase or of a different frequency, the oscillation of the resonator will not be reinforced.

After executing the resonator bands, $N_{newchunk}$ of data has been processed. Processing logic increments the value of the counter variable and tests whether the value of the counter value equals the number of iterations ($N_{iteration}$) (processing block 147). If not, the process transitions to processing block 140 and repeats the placement of new data in the input buffer to process the next $N_{newchunk}$ of data. When $N_{oversample}$ of iterations have been completed, processing transitions to processing block 150.

For every few iterations, say $N_{iterations}$, processing logic extracts tempo data from the resonator banks by combining the amplitudes of all of the resonators in the system (processing block 150) and then groups them by their center frequency (processing block 160). For example, the amplitudes of 1.0 Hz resonators for all the resonator banks are added together to produce a value for the 1.0 Hz frequency. $N_{iterations}$ is not necessarily related to $N_{oversample}$. Values for all frequencies supported by the resonator banks are generated in the same way.

Processing logic sorts the center frequencies by the sum of their amplitudes (processing block 170). The tempos coinciding with periodic elements within the music have larger amplitudes than other tempos. In one embodiment, using a simple hillclimb algorithm, processing logic determines the local maxima and sorts the local maxima by their amplitudes in descending order. Each local maximum corresponds to a possible tempo or subtempo contained within the music.

Processing logic returns the tempos corresponding to the largest local maxima so that the user or the calling application can determine the tempo of the input audio data (processing block 180). In one embodiment, the top ten tempos are returned to the calling application, which will interpret the returned tempos.

Thus, a method for real time tempo detection has been described. In particular, this method provides efficient and reliable real time tempo detection using a computer system such that it is possible to run the tempo detection in the background while running complex applications in the foreground, such as rendering 3D graphics. With an efficient real time tempo detection method, a computer application can arrange visual (image) effects to response to audio input. Thus, a user's experience can be enhanced.

An Exemplary Computer System

Figure 4:
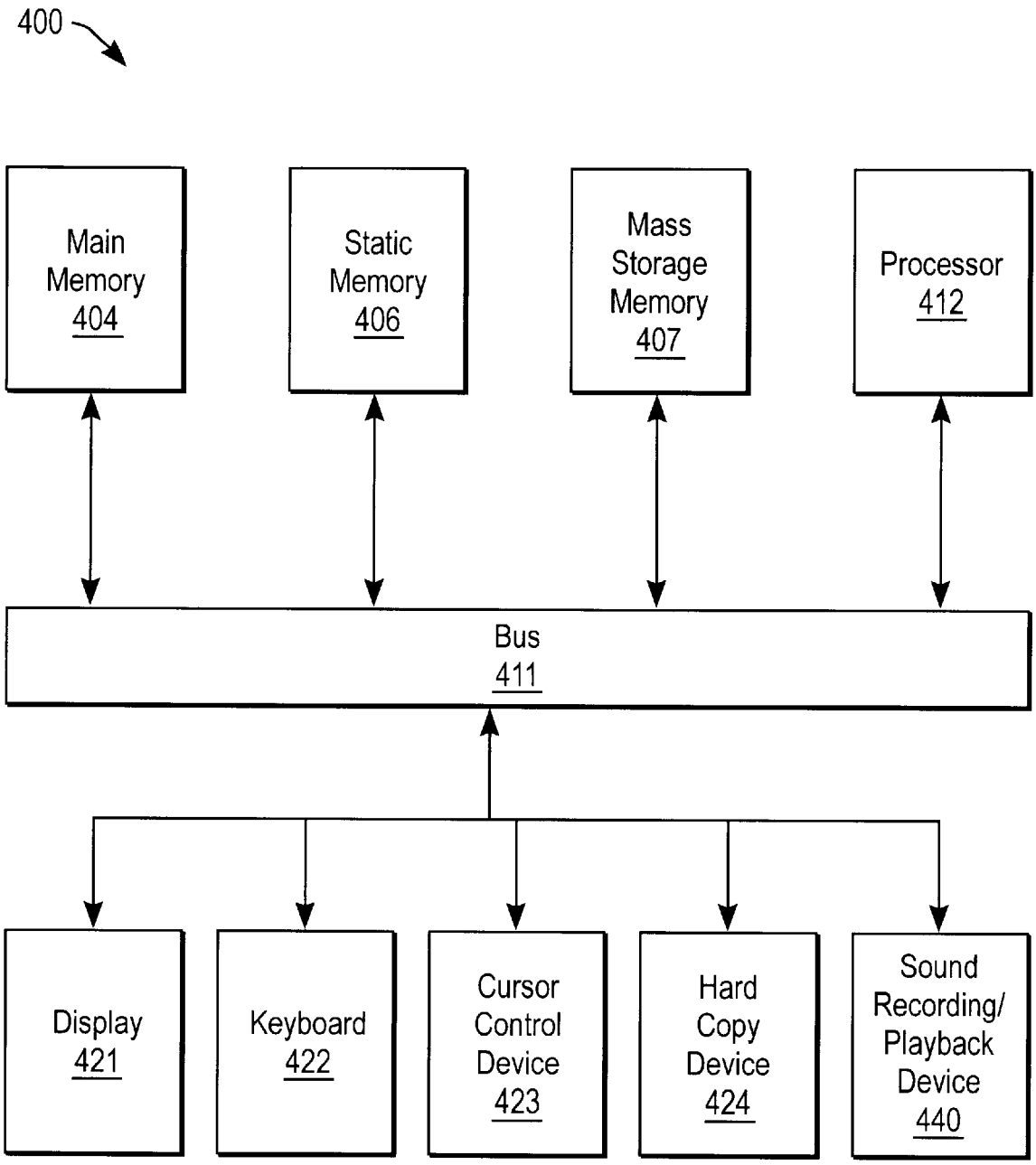
FIG. 4 is a block diagram of an exemplary computer system.

FIG. 4 is a block diagram of an exemplary computer system that may be used to perform one or more of the operations described herein. Referring to FIG. 4, computer system 400 may comprise an exemplary client or server computer system in which the features of the present invention may be implemented. Computer system 400 comprises a communication mechanism or bus 411 for communicating information, and a processor 412 coupled with bus 411 for processing information. Processor 412 includes a microprocessor, but is not limited to a microprocessor, such as Pentium™, PowerPC™, Alpha™, etc.

System 400 further comprises a random access memory (RAM), or other dynamic storage device 404 (referred to as main memory) coupled to bus 411 for storing information and instructions to be executed by processor 412. Main memory 404 also may be used for storing temporary variables or other intermediate information during execution of instructions by processor 412.

Computer system 400 also comprises a read only memory (ROM) and/or other static storage device 406 coupled to bus 411 for storing static information and instructions for processor 412, and a data storage device 407, such as a magnetic disk or optical disk and its corresponding disk drive. Data storage device 407 is coupled to bus 411 for storing information and instructions.

Computer system 400 may further be coupled to a display device 421, such as a cathode ray tube (CRT) or liquid crystal display (LCD), coupled to bus 411 for displaying information to a computer user. An alphanumeric input device 422, including alphanumeric and other keys, may also be coupled to bus 411 for communicating information and command selections to processor 412. An additional user input device is cursor control 423, such as a mouse, trackball, trackpad, stylus, or cursor direction keys, coupled to bus 411 for communicating direction information and command selections to processor 412, and for controlling cursor movement on display 421.

Another device which may be coupled to bus 411 is hard copy device 424, which may be used for printing instructions, data, or other information on a medium such as paper, film, or similar types of media. Furthermore, a sound recording and playback device 440, such as a speaker and/or microphone is coupled to bus 411 for audio interfacing with computer system 400.

Note that any or all of the components of system 400 and associated hardware may be used in the present invention. However, it can be appreciated that other configurations of the computer system may include some or all of the devices.In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

I claim:

1. A computer-implemented method for determining tempo in real time, comprising:

receiving an audio input;

dividing the audio input into a plurality of blocks of data;

converting each of the plurality of blocks of data from time domain data to frequency domain data, the frequency-domain data comprising amplitude and phase data;

stimulating a plurality of resonator banks with the frequency domain data, to cause the resonator banks to generate outputs with various amplitudes;

combining resonator back outputs and grouping amplitudes based on frequency;

identifying a subset of one or more amplitudes indicative of tempos.

2. The method according to claim 1, wherein each block of data is converted from time domain data to frequency domain data using at least one Fast Fourier Transform (FFT).

3. The method according to claim 1, further comprising dividing the frequency domain data into a plurality of frequency bands.

4. The method according to claim 3, further comprising arranging the plurality of frequency bands in a logarithmic distribution.

5. The method according to claim 3, wherein each of the plurality of frequency bands is associated with a resonator bank.

6. The method according to claim 5, wherein the resonator bank comprises of a plurality of resonators, each resonator having a center frequency, further comprising the resonators generating outputs of various amplitudes upon stimulation by the frequency domain data.

7. The method according to claim 1, further comprising filtering out high order noise of the frequency domain data.

8. The method according to claim 7, wherein the frequency domain data is passed through an Impulse Response Function (IRF) to filter out high order noise.

9. The method according to claim 6, further comprising of:

summing amplitudes of the outputs of the resonator of the same center frequency corresponding to a tempo contained within the audio input;

determining local maxima among the summed amplitudes; and sorting the local maxima by their relative amplitudes.

10. The method according to claim 9, further comprising of returning the sorted local maxima for determination of tempo of the audio input.

11. An apparatus for determining tempo in real time, comprising:

means for receiving an audio input;

means for dividing the audio input into a plurality of blocks of data;

means for converting each of the plurality of blocks of data from time domain data to frequency domain data, the frequency-domain data comprising of amplitude and phase data;

means for stimulating a plurality of resonator banks with the frequency domain data, to cause the resonator banks to generate outputs with various amplitudes;

means for combining resonator back outputs and grouping amplitudes according to frequency;

means for identifying a subset of one or more amplitudes indicative of tempos.

12. The apparatus according to claim 11, wherein each block of data is converted from time domain data to frequency domain data using at least one Fast Fourier Transform (FFT).

13. The apparatus according to claim 11, further comprising means for dividing the frequency domain data into a plurality of frequency bands.

14. The apparatus according to claim 13, wherein the frequency bands are arranged in a logarithmic distribution.

15. The apparatus according to claim 13, wherein each of the plurality of frequency bands is associated with a resonator bank.

16. The apparatus according to claim 15, wherein the resonator bank comprises of a plurality of resonators, each resonator having a center frequency, the resonators generating outputs of various amplitudes upon stimulation by the frequency domain data.

17. The apparatus according to claim 11, further comprising means for filtering out high order noise of the frequency domain data.

18. The apparatus according to claim 17, wherein the frequency domain data is passed through an Impulse Response Function (IRF) to filter out high order noise.

19. The apparatus according to claim 16, further comprising of:

means for summing amplitudes of the outputs of the resonator of the same center frequency corresponding to a tempo contained within the audio input;

means for determining local maxima among the summed of the amplitudes; and means for sorting the local maxima by their relative amplitudes.

20. The apparatus according to claim 19, further comprising means for returning the sorted local maxima for determination of a tempo of the audio input.

21. A computer software product including a medium readable by a processor, the medium having stored thereon a sequence of instructions which, when executed by the processor, causes the processor, for each level, to:

receive an audio input;

divide the audio input into a plurality of blocks of data;

convert each of the plurality of blocks of data from time domain data to frequency domain data, the frequency-domain data comprising amplitude and phase data;

stimulating a plurality of resonator banks with the frequency domain data, to cause the resonator banks to generate outputs with various amplitudes;

combine resonator back outputs and group amplitudes according to frequency;

identify a subset of one or more amplitudes indicative of tempos.

* * * * *